US005157840A

United States Patent [19]

Henttinen

[11] Patent Number: 5,157,840

[45] Date of Patent: Oct. 27, 1992

[54] METHOD OF AND AN EQUIPMENT FOR DETERMINING THE POSITION OF A TRACK

[76] Inventor: Matti Henttinen, Kuunkierros 3 D 27, SF-02210 Espoo, Finland

[21] Appl. No.: 566,406

[22] PCT Filed: Feb. 21, 1989

[86] PCT No.: PCT/FI89/00033

§ 371 Date: Oct. 17, 1990

§ 102(e) Date: Oct. 17, 1990

[87] PCT Pub. No.: WO89/07688

PCT Pub. Date: Aug. 24, 1989

[30] Foreign Application Priority Data

Feb. 22, 1988 [FI] Finland ..... 880810

[51] Int. Cl.[5] ..... E01B 29/04

[52] U.S. Cl. ..... 33/287; 33/338; 104/7.2

[58] Field of Search ..... 33/287, 338, 19; 104/7.2, 7.1

[56] References Cited

U.S. PATENT DOCUMENTS

| | | | |
|---|---|---|---|
| 3,371,619 | 3/1968 | Stewart | 104/7.2 |
| 3,381,626 | 5/1968 | Fagan et al. | 104/7.2 |
| 3,545,384 | 12/1970 | Plasser et al. | 104/7.2 |
| 3,659,345 | 5/1972 | Plasser et al. | 33/338 |
| 3,706,284 | 12/1972 | Plasser et al. | 104/7.2 |
| 3,750,299 | 8/1973 | Plasser et al. | 33/287 |
| 3,821,933 | 7/1974 | Plasser et al. | 33/287 |
| 3,902,426 | 9/1975 | Plasser et al. | 104/8 |
| 4,027,397 | 6/1977 | Theurer et al. | 33/287 |
| 4,341,160 | 7/1982 | Nielsen | 104/7.2 |
| 4,724,653 | 2/1988 | Buhler | 104/7.2 |

FOREIGN PATENT DOCUMENTS

| | | |
|---|---|---|
| 366790 | 5/1974 | Austria . |
| 370740 | 10/1974 | Austria . |
| 492829 | 8/1970 | Switzerland . |

*Primary Examiner*—Thomas B. Will

*Attorney, Agent, or Firm*—Fitch, Even, Tabin & Flannery

[57] ABSTRACT

In the method, the actual position of a track (1) is measured and the theoretical position is calculated, and the distance therebetween is calculated or measured, the track repair being controlled directly on the basis of this distance. The method is based on the principle that a survey line is directed from a known point (A) to another known point (B) on the basis of which angle data are obtained. Thereafter the survey line is directed to a measuring point (C) which is observed or controlled continuously. The measuring point (C) moves along the track (1). The distance from the measuring point (C) to the point (A) along the track or along a straight path is measured continuously by an automatic measuring device, in addition to which angle data are measured continuously from the point (A). The position of the track and distances to the known geometry of the track (1) or to the geometry of the track (1) as calculated on the basis of the position data are determined on the basis of these measurements.

12 Claims, 3 Drawing Sheets

METHOD OF AND AN EQUIPMENT FOR DETERMINING THE POSITION OF A TRACK

Figure 1:
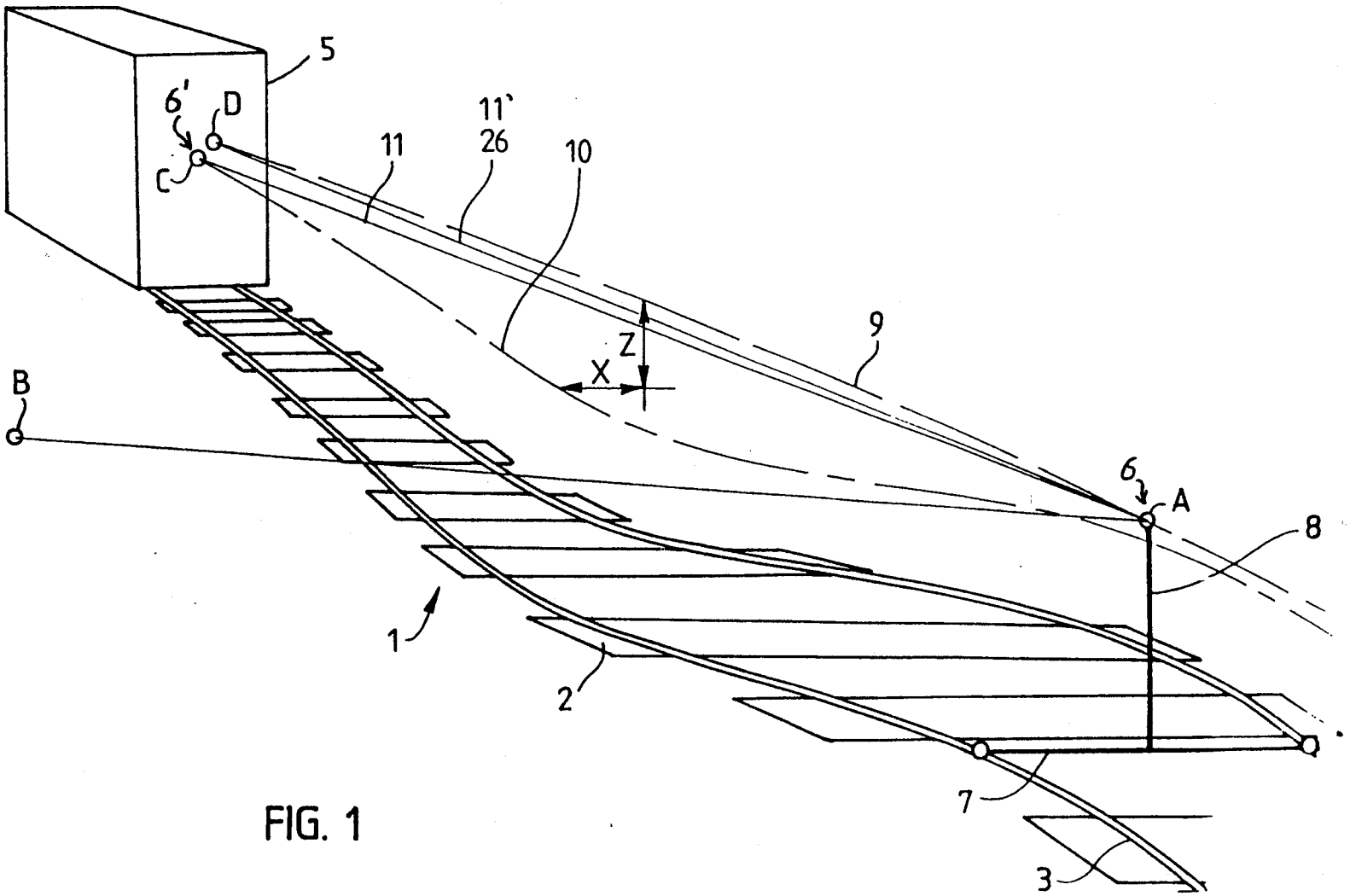

A method of determining the position of a track 1 for placing the track 1 to a desired position, wherein the deviation of the actual position of the track 1 from the desired position of the track 1 in a determined set of coordinates at a predetermined point of the track in the longitudinal direction thereof is determined in at least one direction transverse to the longitudinal direction of the track 1 by measuring, by means of at least one survey line 11; 11' going through a point of reference A having a known position in said set of coordinates, the deviation of the position of a measuring point C determined to be positioned at a determined point relative to the track 1 in the transverse direction thereof at said longitudinal point of the track 1 from the calculated position of a hypothetical point D positioned at a corresponding point relative to the track 1 in the desired position of the track.

The invention is further concerned with an equipment comprising means for determining a survey line 11; 11' and a measuring device 6; 6', 27 and calculating means 20 for measuring and calculating differences between the positions of a measuring point C and a hypothetical point D.

Due to travelling comfort and increased speeds, requirements on the quality of railroad tracks and the like have increased, wherefore the maintenance of tracks has increasingly been carried out by accurate surveying techniques.

As used in the present application and claims, the term "track" refers to the whole formed by rails, switches and crossings of rails attached to an underlying structure such as railway sleepers.

A so called fixed point technique is an accurate survey technique in common use. When applied in the repair of tracks, this technique comprises mapping out the transverse position of the track with regard to its longitudinal position in relation to a theoretical position by measuring its position with respect to a straight survey line going through two positionally determined points in the track, whereby the displacement of the track into a theoretical or desired position in connection with the repair is carried out on the basis of the difference between these values.

Manual fixed point techniques include the measuring of the track with a binocular-surveying rod system between two known points on the track. This is carried out in such a manner that the binocular is positioned on the track at a known point, and the surveying rod is positioned at another known point on the track. Thereafter the binocular is directed to the surveying rod and locked in place, whereby the survey line goes from the binocular to the surveying rod and remains fixedly in place. The surveying rod is then moved along the track and any deviations of the track from the survey line are read at uniform intervals both in the vertical and in the horizontal direction.

This technique can also be applied with a so called improved relative method. The term "relative method" refers to a method wherein the survey lines of a track repair machine move with the machine, distance being measured in relation to these survey lines both for the lifting and the sideward displacement of the track. The forward end as well as the backward end of these survey lines moves with the machine, so the absolute position of the track at each particular point is not known in these methods, but the forward end of the survey line goes along the existing track.

The term "improved relative method" implies that the lifting and displacing values of the track are measured e.g. with the binocular-surveying rod system in such a manner that the absolute positions of the binocular and the surveying rod are not known, but they are set at ocularly selected points along the track while adjusting the direction, and these points on the track remain in place, the vertical and horizontal displacements of the track from the survey line being measured in relation to these points at uniform intervals. In this method, the accurate position of the track is not known, whereas its contour can be made to conform to accepted curvature and inclination contours.

Sideward displacements of the track can also be measured by means of a manual stadia wire method. A stadia wire, which acts as a survey line, is positioned at a predetermined distance from the track, and a distance deviating from this predetermined distance is measured in the middle of the wire. The stadia wire is moved along the track so that the tail end of the stadia wire will be positioned at the former longitudinal position of the stat stadia wire but in the middle of the track, and the deviation distance is measured again. Thereafter the distances so measured, i.e., the rises of arch, can be analyzed further by taking into account the rises of arch on both sides of the point in question. This method can also be regarded as an improved relative method with respect to sideward displacement of the track.

In the field of railway technology, there are three common automatic track-straightening and track-lifting equipments designed for track work machines. It is typical of such equipments that they control the work machine by means of an external stationary survey line, whereby the distance between the survey line and the track varies along the track in accordance with the curvature properties of the track. The utilization of these methods thus requires that the distance and height difference between the track and the survey line are measured and calculated continuously on the basis of the actual and theoretical position of the track while the position of the work machine on the track varies.

In a method utilizing a binocular and radio control means, the track repair machine is controlled with a radio control device similarly as in the abovedescribed binocular-surveying rod system. The binocular is directed to the track repair machine. The binocular and the track repair machine are positioned at known points. Thereafter the binocular is locked in place and the sideward displacement and lifting of the track are controlled by means of the radio control device, while the track repair machine moves along the track. In sideward displacement, the binocular is suited for straight sections only and in lifting both for straight and curved sections but not for vertical bends.

In straight laser control, the radius of sighting of the binocular is replaced with a laser beam indicated by the survey line. The laser beam is correspondingly directed between two known points and locked stationary, whereafter the measuring device measures the distance of the laser beam to a point positioned in the survey carriage in one direction. The laser beam controls directly the displacement of the track. On account of mechanical constructions, this method requires its own laser transmitter and receiver separately for the lifting and sideward displacement of the track. In practice, this method is suited for use only in connection with the sideward displacement of a straight track. In lifting, problems are caused by the length of the laser span, about 350 m, since deflections within such a long distance are greater than what the track repair machine is able to fix. If the span is shortened much, the laser transmitter has to be shifted so often that the performance becomes markedly slower. Another drawback is that this method, similarly to the binocular system, is not applicable in track lifting as far as vertical bends are concerned.

A curve laser method is used only in sideward displacement of a track at curves while the normal straight laser method is used at straight sections in sideward displacements. The curve laser method is based on the principle that the laser transmitter is positioned at a known point on the track and directed to the track repair machine positioned at a known point. The distance between the curve and the laser beam is measured by means of a survey equipment provided in the track work machine, and the measured distance is compared with a distance obtained through calculation, whereafter the track is displaced in the sideward direction over a distance corresponding to this difference.

A drawback of the above-mentioned methods is that their field of use is limited to the measurement of either the sideward or the vertical position in addition to which they are not suitable for measuring the vertical position of curves. Furthermore, they are difficult in use and often require short measuring intervals in order that the measurements could be carried out. Also, it is difficult to apply them in the measurement of the position of tracks curved in the vertical direction while it is difficult if not impossible with horizontally curved tracks.

The object of the present invention is to provide a method which avoids the above drawbacks and by means of which the position of a track can be determined easily, simply and rapidly and as automatically as possible both in the vertical and horizontal direction within track section which may be straight or curved in various ways so that the track can be displaced to a desired position on the basis of the results so obtained. In the invention, this is achieved in such a manner that the survey line 11; 11 is a straight line going from the point of reference A to one of the points C; D, said line turning about the point of reference A when the position of the point in question changes;

that the direction of the survey line 11; 11' in said set of coordinates is determined by means of a measuring device 6;

deviations between the positions of the points C; D both in the vertical and horizontal direction of the track 1 are determined through calculation on the basis of the data so obtained and the longitudinal position of the track 1; and that the track is displaced to the desired position utilizing the deviation values so determined.

The basic idea of the invention is that the survey line is a turning survey line going through a point of reference with a known position. This survey line is a straight line between the point of reference A and a measuring point positioned in a survey carriage or a hypothetical point positioned at a corresponding transverse point relative to the track in the desired position of the track, whereby the direction of the survey line changes with a change in the longitudinal position of the track, and the deviation of the track from the desired position can be determined by measuring the direction of the survey line in a set of coordinates defined by the position of the point of reference and by calculating on the basis of the direction data so obtained and the longitudinal position of the track or by measuring the deviation from the survey line calculated on the basis of the coordinate data of the desired position and the position of the known point. In one embodiment of the basic idea of the invention, an automatic theodolite or the like direction determination device is positioned at the point of reference of the measuring point. The theodolite or the like observes a reflector positioned at the other point, respectively, thus determining automatically the angle data of the survey line, whereby the whole survey and calculation process is carried out automatically when connected to a calculator. In another embodiment of the basic idea of the invention, the direction of the survey line is determined by first calculating the direction of the straight line between the point of reference and the hypothetical point at each longitudinal point of the track, whereby a laser transmitter or the like controlled by the calculator is positioned at the point of reference for transmitting a laser beam via the hypothetical point. The transmitter turns automatically in response to the calculator to the hypothetical point corresponding to each point on the track, so that any deviations between the measuring point and the hypothetical point can be measured directly with a measuring device observing the laser beam. The measuring device indicates the deviation of the beam at this particular point from the position of a point defined in relation to the measuring device.

After the determination of the absolute position of the point to be determined, it is compared with position values obtained through calculation for a point at the distance in question; the track can then be displaced in the direction of the desired position on the basis of the difference values so obtained. According to the basic idea of the invention, said measuring device can reversely be positioned at the measuring point, whereby it observes the point of reference having a known position, thus indicating the direction of the survey line between the measuring point and the point of reference.

A further object of the invention is to provide an equipment for realizing the method, which equipment is characterized in that said means for determining the survey line comprise a follower device 15; 24 belonging to the measuring device 6; 6', the follower device being arranged to be automatically positioned in the direction of the survey line 11; 11'; and that the measuring device 6; 6', 27 and the follower device 15; 24 belonging thereto are connected to the calculating means 20 measuring and calculating automatically deviations between the positions of the measuring point C and the hypothetical point D on the basis of the direction of the survey line 11; 11' and the longitudinal position of the track 1.

The basic idea of the equipment is that it comprises, as a measuring device, a theodolite or the like measuring device capable of observing a determined point, such as a detector, sensor or a reflector, determining the direction of the survey line in a determined fixed set of coordinates. As the measuring device is positioned at the point of reference having a known position and as it is connected to a calculator, it can continuously and automatically determine the absolute position of the object to be determined in relation to a known point. By comparing the obtained position data with desired position data obtained through calculation, the position differences can be determined both in the vertical and the horizontal direction, whereby it is possible to determine in which direction and to what extent the track should be displaced at each particular point in order to get it into the desired position. Correspondingly, the measuring device can be positioned at the point of reference to observe a known point and to determine its own position, that is, the position of the point of reference.

The method and the equipment according to the invention have a number of advantages. The invention reduces considerably the need of human labour, and the measurements need not be made separately for each period of work. In addition, the invention reduces the disturbances caused to track traffic by the surveying work, and the accident-prone work amongst the track traffic is nearly fully eliminated. The method and the equipment according to the invention are suited for use both within straight sections and at curves in sideward displacement as well as in lifting, whatever the geometry of the track.

A further advantage of the invention is that the mechanic parts at the measuring point do not limit the length of the survey line, and the equipment at the measuring point is considerably simpler. At curves, the track repair machine or track survey carriage can utilize the turning survey radius following it over a much longer distance than with a corresponding fixed survey line without the radius being directed again, because the distance between the track and the survey radius does not vary while the machine or carriage advances along the track. In addition, this one and the same survey line can simultaneously be utilized in the determination of data on the height position so that the straightening and lifting of the track can now be indicated in this way or the level and height position can be measured by means of a single radius, while two separate survey lines or radii are required for the purpose in prior art methods based on the use of a fixed survey line. Furthermore, the known point can be selected from outside the track, whereby there is no need to determine it again, e.g., between other traffic.

Figure 2:
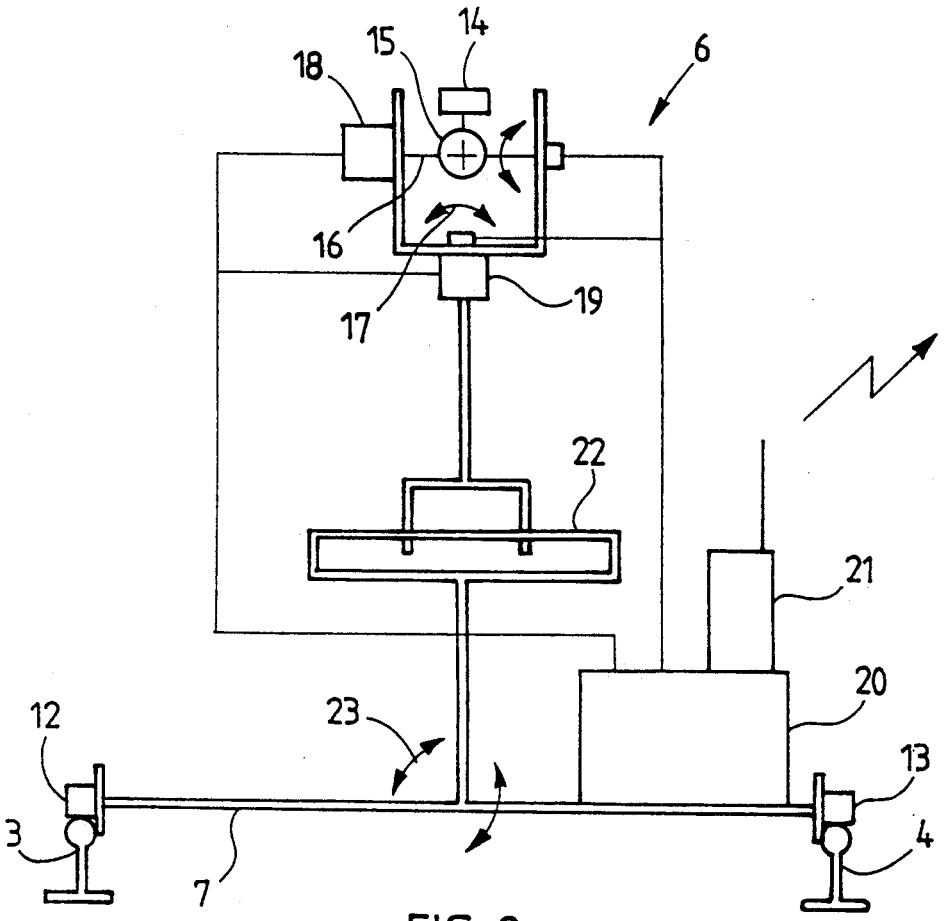
Figure 3A:
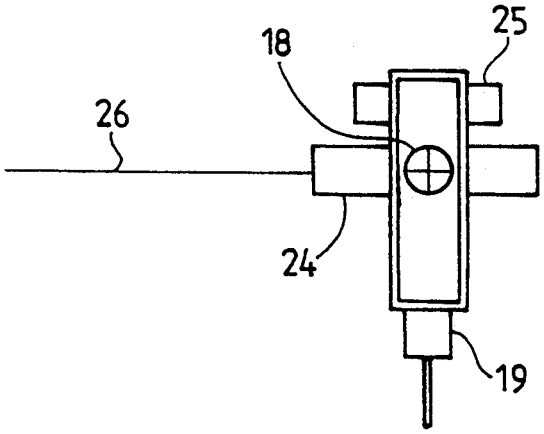

The invention will be described in more detail in the attached drawings, wherein FIG. 1 is a schematical view of the method according to the invention;

FIG. 2 is a schematical view of a survey equipment suited for realizing the method; and FIGS. 3A and B and 4 illustrate schematically another equipment suited for realizing the method.

FIG. 1 shows a section of a track 1 comprising two rails 3 and 4 attached to railway sleepers 2. A survey carriage 5 moving along the rails 3 and 4 is positioned on the track 1.

As used in the present application and claims, the term "survey carriage" refers either to a separate equipment movable along the track or to an equipment contained in a track repair carriage, wherein a measuring point C is so determined in relation to the equipment that it follows the rail determining the position of the track in the sideward and vertical direction.

There is further provided a measuring device 6 on the track 1, comprising a stand 7 resting on the rails 3 and 4 and provided with an arm 8. The measuring device 6 is positioned at the end of the arm 8.

The measuring device 6 has its own point of reference A relative to which it carries out all the measurements. If the absolute position of the track 1 at the measuring device 6 is known, the position of point A is also known, because it is positioned at a predetermined point relative to the track. If the position of the track 1 is not known, the position of point A can be determined, e.g., by directing the measuring device 6 to a point B having a known position and by measuring the distance and the direction in the set of coordinates of point B, thus determining the position of point A relative to the known point B and, accordingly, the absolute position of point A in the same set of coordinates.

In FIG. 1, the reference numeral 9 indicates the path along which a hypothetical point (D) theoretically moved relative to the desired position of the track 1, while the reference numeral 10 indicates the path along which a point of reference (C) moves when the survey carriage 5 moves along the track in its actual, that is, absolute position. Coordinates x and z indicate the deviation of the actual position of the track 1 from the theoretical position at each longitudinal point of the track 1. The straight line between the point of reference (A) of the measuring device 6 and the measuring point (C), that is, the survey line turning about point A, is indicated with the numeral 11.

Thereafter the measuring device 6 is directed to an object 6 positioned at point C in the survey carriage 5, such as a detector, sensor or reflector, and it is arranged to automatically observe it so that it indicates the direction of the survey line 11 in the set of coordinates used. At the same time the measuring device 6 measures the distance between points A and C and the direction from point A to point C in the set of coordinates of the measuring device. In this case, the straight line between points A and C is the survey line 11 turning relative to point A, by means of which the position of the track 1 can be determined. Since the position of point A in said set of coordinates is known, the absolute position of point C can thus be measured at each point of the track 1. By comparing the values so obtained at each point of the track 1 with the calculated values of point D corresponding to the theoretical or desired position, it can be determined on the basis of the difference values in which direction and to what extent the track 1 should be displaced at each point. The longitudinal position of the track may be measured by measuring wheels rotating along at least one rail of the track. If the survey carriage 5 is a track repair carriage which can carry out the displacements the corrections can be carried out immediately, simultaneously checking that the end result is such as desired.

The method is suitable for surveying straight track sections as well curved track sections of various kinds, because the surveying of the position of point (C) is in no way prevented, not even with great radii of curvature and great deflections in the vertical or horizontal direction. The length of the survey span to be used in each particular case can be adjusted in accordance with the direct visibility on the track and in the vicinity thereof, whereby a fairly long survey span is obtained even with narrow track areas when the fixed point A is positioned outside the track at a curve.

FIG. 2 shows a survey equipment arranged to rest on the rails 3 and 4 so as to be movable on wheels 12 and 13. The survey equipment comprises a measuring device 6 provided with a distance gauge 14 automatically measuring distance to point (C), and a follower 15 following point (C), that is, a reflector surface serving as an object 6' positioned at said point. When the follower 15 turns about its horizontal axis 16 and its vertical axis 17, sensors 18 and 19 measure the turning angle and the angle values similarly as the distance value are applied to a calculating unit 20, which calculates on the basis thereof the position of point C as well as deviations from the desired position. The measured and calculated results can then be transferred by means of a radio 21, for instance, to the survey carriage 5 or to the track repair carriage for the repair. The stand 7 may comprise a sideward displacement mechanism 22 by means of which the measuring device 6 can be displaced in the transverse direction of the track 1 and a turning means 23 by means of which the measuring device 6 can be positioned in a horizontal position when the track is inclined in the transverse direction.

Figure 3B:
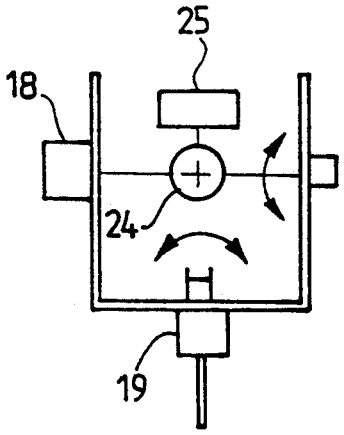
Figure 4:
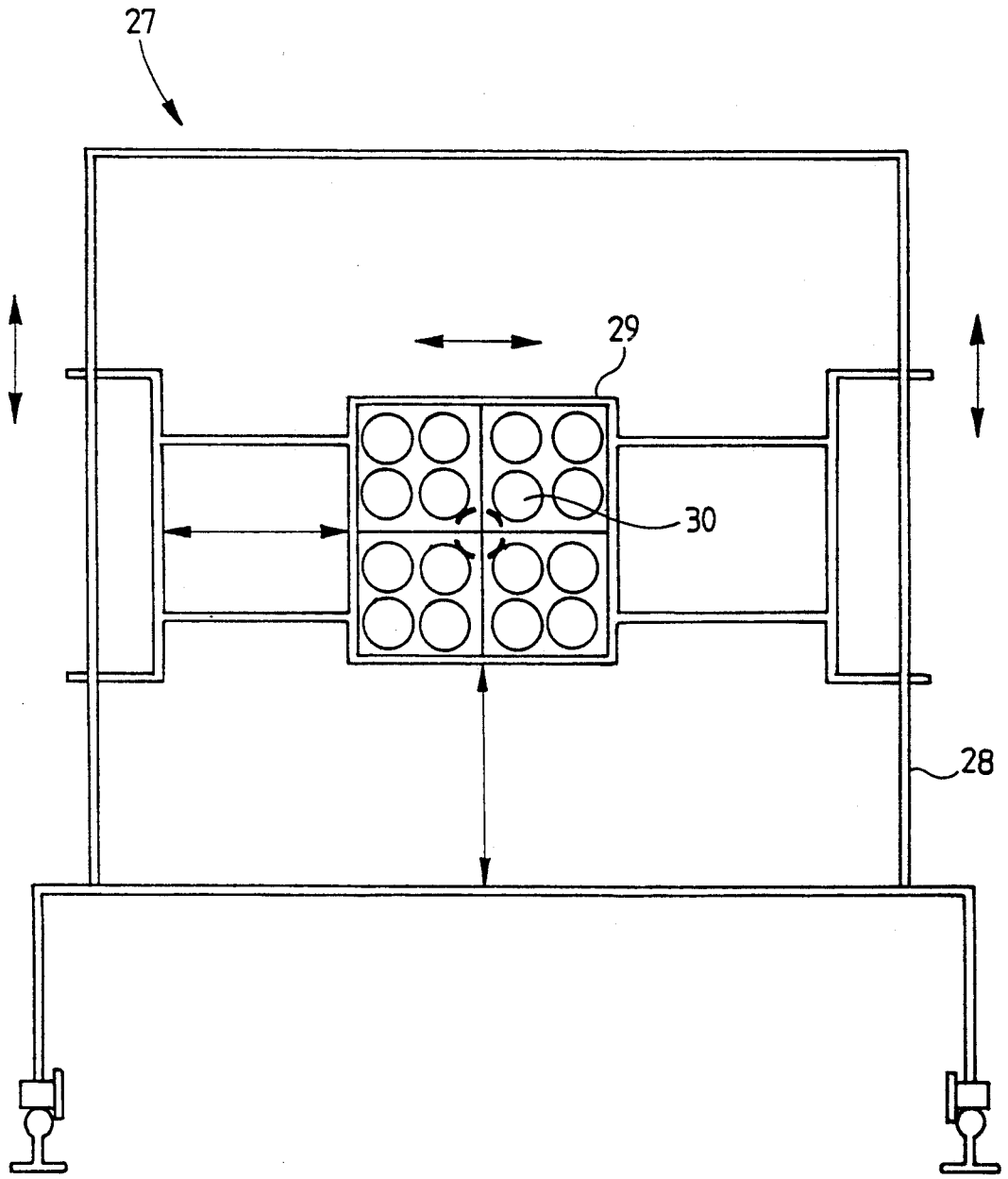

In the survey equipment shown in FIGS. 3 and 4, the measuring device 6, provided at point (A) for measuring direction and distance, is replaced with a laser transmitter 24 provided at point (A) and a distance gauge 25 provided therein. On the basis of the distance measured by the distance gauge 25, the laser transmitter 24 is directed to a direction in which the radius 26 goes at a corresponding distance through a hypothetical point (D) calculated on the basis of the desired position of the track 1, whereby a survey line indicated with the numeral 11' in FIG. 1 is obtained. The position of the hypothetical point (D) relative to the position of the track in the desired position is the same as the position of the measuring point (C) relative to the actual track. The survey carriage 5 comprises detecting means 27 having a detecting cell assembly 29 mounted in a framework 28 movably both in the vertical and horizontal direction. The measuring cell assembly 29 is positioned at point (C) and it follows the track 1 in such a manner that it rests on both rails and is pressed against one rail, 3, for instance, in the sideward direction. Said selected rail 3 serves as a so called roller race for the sideward displacement, that is, the sideward displacements of the track 1 are determined in relation to said rail 3. Correspondingly, one of the rails 3 and 4 is selected to serve as a roller race for lifting. When the laser beam 26 impinges on the measuring cell assembly 29, its photocells 30 indicate the position of the beam and control means (not shown) displacing the measuring cell assembly 29 in such a manner that the laser beam 26 impinges on the measuring cell assembly 29 in the middle thereof. The position of the measuring cell assembly 29 relative to the framework 28 thereby indicates the deviations of the track 1 from the theoretical position of the track 1. The position of the framework 28 in the horizontal position is measured, and measurements between the measuring cell assembly 29 and the framework 28 caused by the inclination of the track 1 are corrected by calculation on the basis of the result of the inclination measurement automatically into vertical and horizontal deviations of the track 1.

Only some embodiments of the method and the equipment according to the invention have been described above, and the invention is by no means bound thereto, but it can be freely modified within the scope of the claims.

Instead of point (A) the measuring device 6 may be positioned in the survey carriage or the like, whereby it measures the position of point (C) relative to point (A) by means of detectors or the like provided therein. The distance gauge and the direction measuring device may be position apart from each other one at point (A) and the other at point (B).

The survey equipment may be positioned on separate survey bases movable along the rails, though the device at point (A) may also rest on the ground, because its position, once defined, remains the same.

The survey equipment can, of course, be used either merely for vertical or horizontal determination of position.

I claim:

1. A method of displacing a track from an actual position to a desired position comprising the steps of:
   (a) providing a system of coordinates;
   (b) providing a measuring device defining a point of reference having a known position in the system of coordinates;
   (c) providing a measuring carriage on the track at a predetermined longitudinal position on the track;
   (d) providing a measuring point on the measuring carriage at a determined point relative to the actual position of the track;
   (e) calculating a hypothetical point at a corresponding determined point relative to the desired position of the track;
   (f) providing a survey line from the point of reference to the measuring point;
   (g) determining the longitudinal position of the measuring point;
   (h) measuring the direction of the survey line in the system of coordinates by the measuring device;
   (i) determining the transverse vertical and horizontal deviation of the position of the measuring point from the position of the hypothetical point based upon the direction of the survey line and the longitudinal position of the measuring point;
   (j) advancing the measuring carriage and measuring point along the track;
   (k) changing the direction of the survey line as necessary as the measuring point changes position;
   (l) repeating steps (g), (h), (i), (j) and (k) for a desired number of repetitions; and
   (m) displacing the track both vertically and horizontally to the desired position using the determined deviations.

2. A method in accordance with claim 1 wherein the step of determining the longitudinal position of the measuring point comprises:
   measuring the distance between the point of reference and the measuring point simultaneously with the step of measuring the direction of the survey line; and
   determining the longitudinal position of the measuring point from the distance and the direction so measured.

3. A method in accordance with claim 1 wherein the step of determining the longitudinal position of the measuring point comprises rotating measuring wheels along at least one rail of the track.

4. A method in accordance with claim 1 wherein the measuring device is automatically positioned in the direction of the survey line; and wherein repeating steps (g), (h), (i), (j) and (k) is done automatically and substantially continuously.

5. A method in accordance with claim 2 wherein the step of determining the longitudinal position of the measuring point comprises rotating measuring wheels along at least one rail of the track.

6. A method in accordance with claim 2 wherein the measuring device is automatically positioned in the direction of the survey line; and wherein repeating steps (g), (h), (i), (j) and (k) is done automatically and substantially continuously.

7. A method in accordance with claim 3 wherein the measuring device is automatically positioned in the direction of the survey line; and wherein repeating steps (g), (h), (i), (j) and (k) is done automatically and substantially continuously.

8. A method in accordance with claim 5 wherein the measuring device is automatically positioned in the direction of the survey line; and wherein repeating steps (g), (h), (i), (j) and (k) is done automatically and substantially continuously.

9. An apparatus for displacing a track in a system of coordinates from an actual position to a desired position, comprising:

a measuring device defining a point of reference having a known position in the system of coordinates;

a measuring carriage on the track;

a measuring point on the measuring carriage at a determined point relative too the actual position of the track;

means for calculating a hypothetical point at a corresponding determined point relative to the desired position of the track;

means for providing a survey line between the point of reference and the measuring point;

means for determining the longitudinal position of the measuring point;

means for measuring the direction of the survey line in the system of coordinates by the measuring device;

means for determining transverse vertical and horizontal deviation of the position of the measuring point from the position of the hypothetical point based upon the direction of the survey line and the longitudinal position of the measuring point;

means for advancing the measuring carriage and measuring point along the track;

means for changing the direction of the survey line as the measuring point changes position; and means for displacing the track both vertically and horizontally to the desired position using the determined deviations.

10. An apparatus in accordance with claim 9 wherein the means for changing the direction of the survey line is a follower device having an object positioned at the measuring point and an automatic theodolite positioned at the reference point to follow the measuring point to make the necessary changes in the direction of the survey line as the measuring point changes position.

11. An apparatus in accordance with claim 9 wherein the means for changing the direction of the survey line is a follower device having an object positioned at the point of reference and an automatic theodolite positioned at the measuring point to follow the point of reference to make the necessary changes in the direction of the survey line as the measuring point changes.

12. An apparatus in accordance with claim 9 further comprising a distance gauge to automatically measure the distance between the point of reference and the measuring point; and wherein the means for determining the longitudinal position of the measuring point is arranged to calculate the longitudinal position based on the distance so automatically measured.

* * * * *

UNITED STATES PATENT AND TRADEMARK OFFICE

CERTIFICATE OF CORRECTION

PATENT NO. : 5,157,840

DATED : October 27, 1992

INVENTOR(S) : Matti HENTTINEN

It is certified that error appears in the above-identified patent and that said Letters Patent is hereby corrected as shown below:

In Column 2, line 25, delete the word "stat".

In Column 2, line 47, change "abovedescribed" to read --above-described--.

In Column 6, line 25, change "6" to read --6'--.

IN THE CLAIMS:

In Column 9, line 20 (Claim 9, line 8) change "too" to read --to--.

Signed and Sealed this

Sixteenth Day of November, 1993

*Attest:*

*Attesting Officer*

Bruce Lehman

BRUCE LEHMAN

*Commissioner of Patents and Trademarks*